US005327147A

United States Patent [19]

Caille et al.

[11] Patent Number: 5,327,147

[45] Date of Patent: Jul. 5, 1994

[54] MICROWAVE ARRAY ANTENNA HAVING SOURCES OF DIFFERENT WIDTHS

[75] Inventors: Gérard Caille, Tournefeuille; Frédéric Magnin, Toulouse, both of France

[73] Assignee: Alcatel Espace, Courbevoie, France

[21] Appl. No.: 918,034

[22] Filed: Jul. 24, 1992

[30] Foreign Application Priority Data

Jul. 26, 1991 [FR] France ..... 91 09506

[51] Int. Cl.[5] ..... H01Q 1/38; H01Q 13/02

[52] U.S. Cl. ..... 343/700 MS; 343/754; 343/786; 343/853

[58] Field of Search ..... 343/700 MS, 754, 770, 343/840, 853, 772, 786; 342/368, 371, 372, 374, 157

[56] References Cited

U.S. PATENT DOCUMENTS

| | | | |
|---|---|---|---|
| 3,438,040 | 4/1969 | Radford | 343/778 |
| 3,460,150 | 8/1969 | Mei | 343/792.5 |
| 3,530,478 | 9/1970 | Corzine et al. | 343/771 |
| 3,553,692 | 1/1971 | Drabowitch | 343/786 |
| 4,364,052 | 12/1982 | Ohm | 343/781 P |
| 4,414,550 | 11/1983 | Tresselt | 343/700 MS |
| 4,594,595 | 6/1986 | Struckman | 343/770 |
| 4,758,842 | 7/1988 | Linhardt et al. | 343/786 |
| 4,980,692 | 12/1990 | Rudish et al. | 343/700 MS |
| 5,023,634 | 6/1991 | Nishioka | 342/368 |
| 5,027,125 | 6/1991 | Tang | 342/368 |
| 5,124,712 | 6/1992 | Caille et al. | 342/368 |
| 5,166,690 | 11/1992 | Carlson et al. | 342/157 |
| 5,206,655 | 4/1993 | Caille et al. | 343/853 |

FOREIGN PATENT DOCUMENTS

| | | | |
|---|---|---|---|
| 3839945 | 5/1990 | Fed. Rep. of Germany | H01Q 3/26 |

OTHER PUBLICATIONS

Huang et al, "MicroStrip Yagi Array Antenna for Mobile Satellite Vehicle Application", Jul. 1991, IEEE vol. 39, pp. 1024–1030.

*Primary Examiner*—Donald Hajec
*Assistant Examiner*—Tan Ho
*Attorney, Agent, or Firm*—Sughrue, Mion, Zinn, Macpeak & Seas

[57] ABSTRACT

A microwave array antenna comprises a plurality of like unit sources whose width increases progressively from the center of the array towards its ends and which are disposed relative to each other in such a way that substantially no illumination gaps are created in the array.

17 Claims, 3 Drawing Sheets

MICROWAVE ARRAY ANTENNA HAVING SOURCES OF DIFFERENT WIDTHS

BACKGROUND OF THE INVENTION

1. Field of the Invention

The present invention concerns a microwave array antenna, for example a linear array adapted to be disposed along the focal line of a cylindrical-parabolic reflector.

2. Description of the Prior Art

Array antennas are designed to produce adaptive diagrams from a plurality of unit sources such as horns, helixes, dipoles, patches (small conductive patterns of rectangular shape, for example, etched on a substrate), etc.

By combining each unit source with a variable phase-shifter an electronically scanned antenna whose beam can be "depointed" (in other words: scanned) very quickly is obtained.

The simplest array antenna is the conventional linear array antenna which comprises in a single line a smaller or greater number of identical unit sources spaced at a regular pitch, the pitch being the distance from the centre of one source to that of the adjacent source.

By producing an array in a similar manner but in two orthongonal dimensions rather than a single dimension a "plane array" is obtained, often rectangular in shape, possibly with cut-off corners.

Similarly, by adopting a hexagonal grid it is possible to produce an array in the form of a plane body of revolution.

The drawback of all these regular pitch array antennas is that a large antenna requires a very large number of unit sources, to the point that the cost of an antenna of this kind can become prohibitive.

To reduce the number of unit sources some authors have considered the creation of "thinned" or "gapped" arrays by eliminating some sources either randomly or according to a deterministic law established mathematically on the basis of the theory of antennas, the number of sources removed increasing towards the edges of the array antenna. In all these implementations the unit sources of the array are identical to each other.

Such "thinning" reduces the number of unit sources without deteriorating the shape of the main lobe or causing "array lobes" to appear in the radiation pattern of the antenna (in other words, peaks in unwanted directions). Unfortunately this significantly reduces the gain of the antenna, which falls by 10 log R where R is the proportion of sources remaining: if half the unit sources are removed, the total antenna gain is reduced by 3 dB.

In many applications this degree of gain loss is prohibitive:

- for a telecommunication transmit antenna, to maintain the same link balance it would be necessary to double the transmitted power, which is rarely possible;
- for a radar antenna, the gain of which is relevant both to transmission and reception, it would be necessary to quadruple the transmitted power.

The invention is directed to remedying these drawbacks.

SUMMARY OF THE INVENTION

The present invention consists in a microwave array antenna comprising a plurality of like unit sources whose width increases progressively from the center of the array towards its ends and which are disposed relative to each other in such a way that substantially no illumination gaps are created in the array.

The progressive increase in the dimensions of the sources preferably follows a geometrical progression variation law.

The invention will be clearly understood and its other features and advantages will emerge from the following description of a few non-limiting embodiments given with reference to the appended diagrammatic drawings.

DETAILED DESCRIPTION OF THE INVENTION

Figure 1:
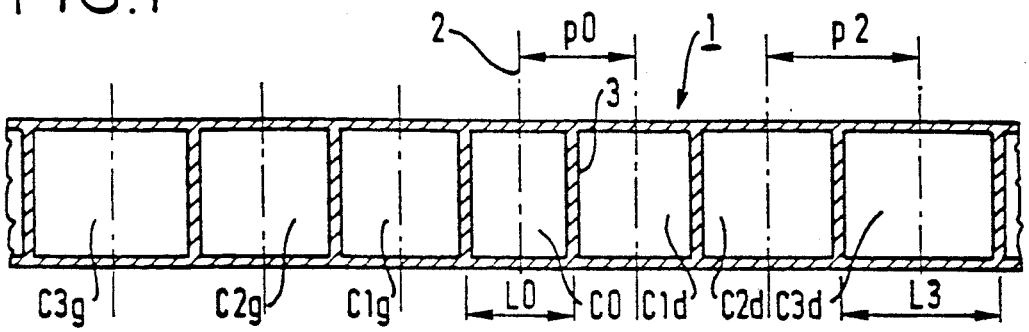
FIG. 1 is a front view of the central part of a linear array in accordance with the invention and comprising a plurality of horns, this array being designed to be disposed along the focal line of a cylindrical-parabolic reflector, for example.
Figure 2:
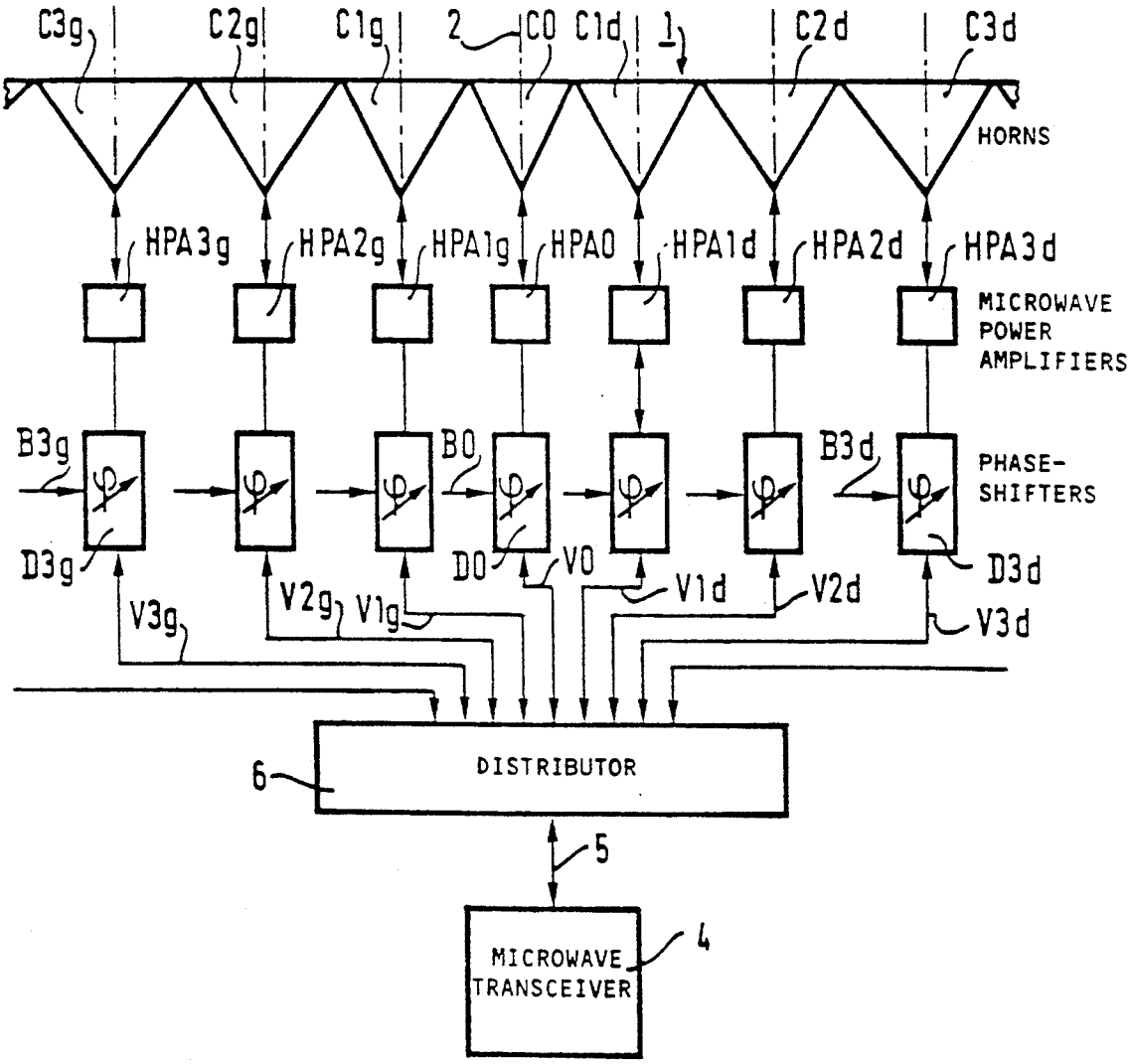
FIG. 2 is a block diagram of the electronic beam scanning transmit-receive circuit which may be associated with the FIG. 1 array.

Referring to FIGS. 1 and 2, a linear array 1 is made up of a plurality of adjacent radiating horns including a central horn C0 lying between two identical series of horns symmetrical to the central axis 2 of the horn C0 and therefore of the array 1:

- a first series of horns C1d, C2d, C3d, etc. on the righthand side (as seen in the drawing) of the central horn C0; and
- a second series of horns C1g, C2g, C3g, etc on the lefthand side of the central horn C0.

To prevent illumination gaps in the radiation pattern of the array 1 there is virtually no real separation between two adjacent horns, which are therefore separated by a common wall such as the wall 3 in the drawing joining the horn C0 and the horn C1d.

The horns are not identical, and their width L and consequently the pitch p between the respective axes of two adjacent horns increase progressively on either side of the central horn C0 and identically to the right and to the left of the latter, in the direction away from the central horn C0 towards the respective righthand and lefthand ends of the array 1, while the height of the horns, i.e., the vertical dimension of the horns in the direction perpendicular to the width L in FIG. 1, does not progressively increase from the center of the array towards its ends.

The law governing the variation in the width of the horn is preferably a geometrical progression law, for example a law of the form:

$$Ln = L0(1+k)^{n-1}$$

where k is a constant increase factor, equal to 0.1, for example, L0 is the width of the central horn C0 and Ln is the width of the horn of rank n (Cnd or Cng).

The pitch pn is defined in terms of the pitch p0 by the same equation, of course, especially in the case of the array antenna 1 shown in which all the sources are contiguous.

The antenna array shown in FIG. 1 may be designed, for example, to be disposed along the focal line of a conventional cylindrical-parabolic reflector (not shown) in order to cause a thin lobe to be scanned by an antenna of this kind in the plane determined by the array and the line through the tips of the parabolic sections.

FIG. 2 is a block diagram of the electronic circuitry associated with the array 1.

The diagram is somewhat conventional. It comprises a microwave transmitter-receiver 4 connected by a bidirectional ].ink 5 to a distributor 6 whose function is to distribute the transmitted or received energy uniformly between the various output or input channels V0, V1d, V1g, V2d, V2g, V3d, V3g, etc. and respectively feeding the horns C0, C1d, C1g, C2d, C2g, C3d, C3g, etc.

Each channel comprises in succession:

a respective phase-shifter D0, . . . , D3d, D3g, etc. receiving on its control terminal B0, . . . , B3d, B3g, etc. a phase shift control signal from a pointer controlled by a central computer (not shown) generating the phase law according to the required pointing function;

between this phase-shifter and the associated horn, a respective microwave power amplifier HPA0, . . . , HPA3d, HPA3g, etc.

Figure 5:
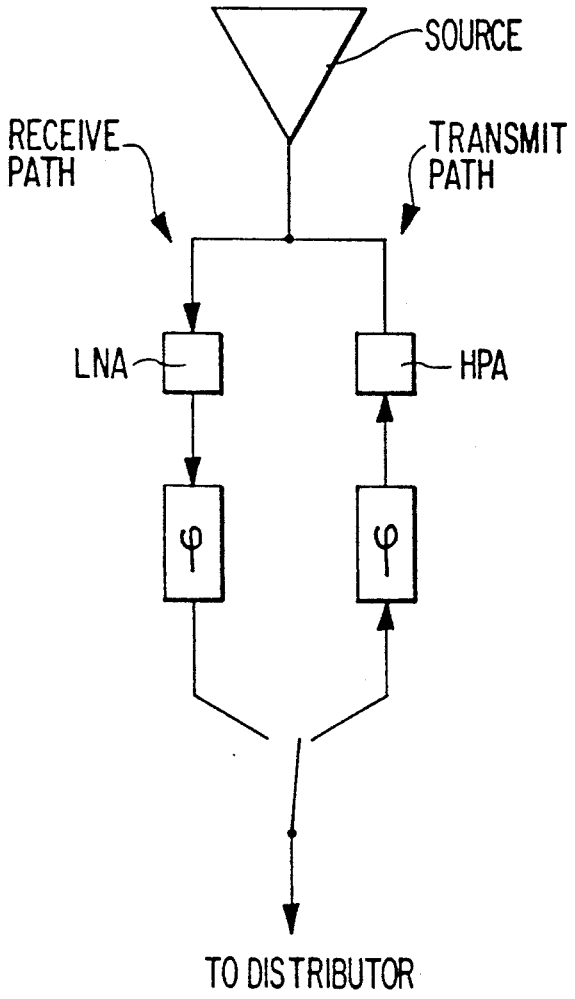
FIG. 5 illustrates in more detail the arrangement of amplifiers and phase shifters shown in FIG. 2.

It will of course be understood that in operation of such an antenna array there is a transmit path and a receive path, and this more detailed arrangement is illustrated in FIG. 5 where it is shown that each amplifier and phase shifter of FIG. 2 may in fact comprise a transmit path including a phase shifter and high power amplifier and a receive path having a low noise amplifier and a phase shifter, with the two paths being alternately switched in and out for transmission and reception.

In the regular arrays of the prior art it was necessary to provide on the output side of the horns or other unit sources microwave amplifiers whose gain decreased in the direction away from the central horn because the radiation diagram required of this kind of antenna required that the transmitted power density decreased progressively away from the center of the array.

With an array in accordance with the invention, this power variation condition is achieved by construction because the pitch of the array increases progressively away from the central horn C0.

Consequently, there is no need for power amplifiers HPA0, . . . , HPA3d, HPA3g, etc. whose gain varies and an advantageous feature of the invention is that all the amplifiers are identical and have the same power rating.

This power rating is highly advantageously the maximum and optimum power for which the amplifiers are designed. This maximizes the total power and the energy efficiency is optimized because each amplifier operates at the maximum output for which it is designed.

The central horn C0 has the same width (around 2 cm, for example) as that of a regular array of the prior art.

To avoid excessively increasing the number of types of horns, the progressive increase in their width is advantageously effected by groups of horns. For example, five consecutive horns, on the righthand side and on the left, would have the same width, the next five also identical to each other but slightly wider, and so on.

In this way it has proved possible to halve the number of horns required for a linear array approaching six meters having to scan an elongate beam approximately six degrees either side of the normal. For a comparable radiation pattern quality, the reduction in gain was only in the order of 0.35 to 0.4 dB.

Figure 3:
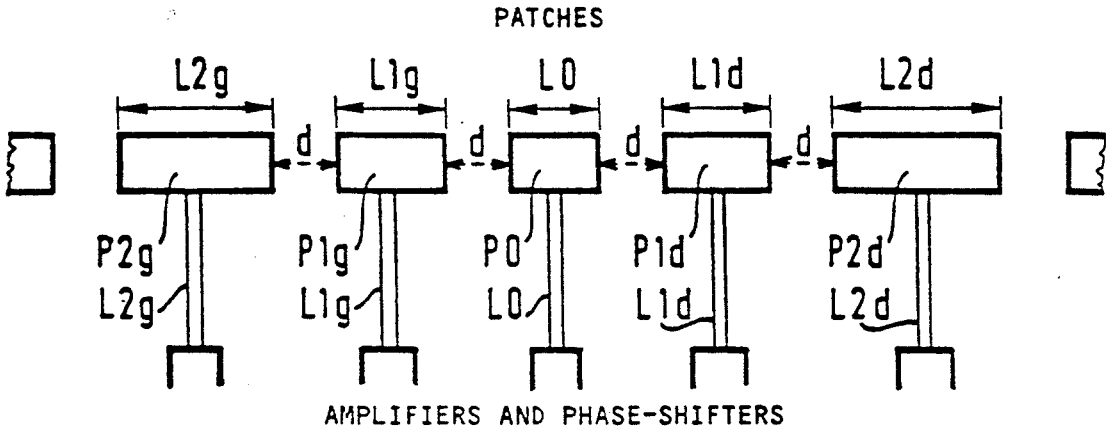
FIG. 3 is a simplified plan view of an implementation similar to that of FIG. 1 but using resonant patches.

FIG. 3 is a highly diagrammatic representation of an antenna array of the same type but made of resonant patches. The unit source designations C0, C1d, C1g, C2d, C2g, etc. have been respectively replaced with designations, P0, P1d, P1g, P2d, P2g, etc. identifying the patches which replace the horns of the previous embodiment.

Each patch is connected to its respective amplifier and phase-shifter by a respective line L0, L1d, L1g, L2d, L2g, etc.

According to the invention, the dimensions (that is to say the non-resonant widths L0, L1d, L1g, L2d, L2g, etc.) of the patches increase progressively from the center P0 of the array towards its opposite ends, for example according to the previously defined geometrical law and therefore such that:

$$L_n/L_{n-1}=1+k$$

Also in accordance with the invention, to prevent any illumination gap in the array all the patches are separated from the others by a common distance d between adjacent edges which is equal to half the guided wavelength, this condition being a familiar one in this art for avoiding illumination gaps.

Figure 4:
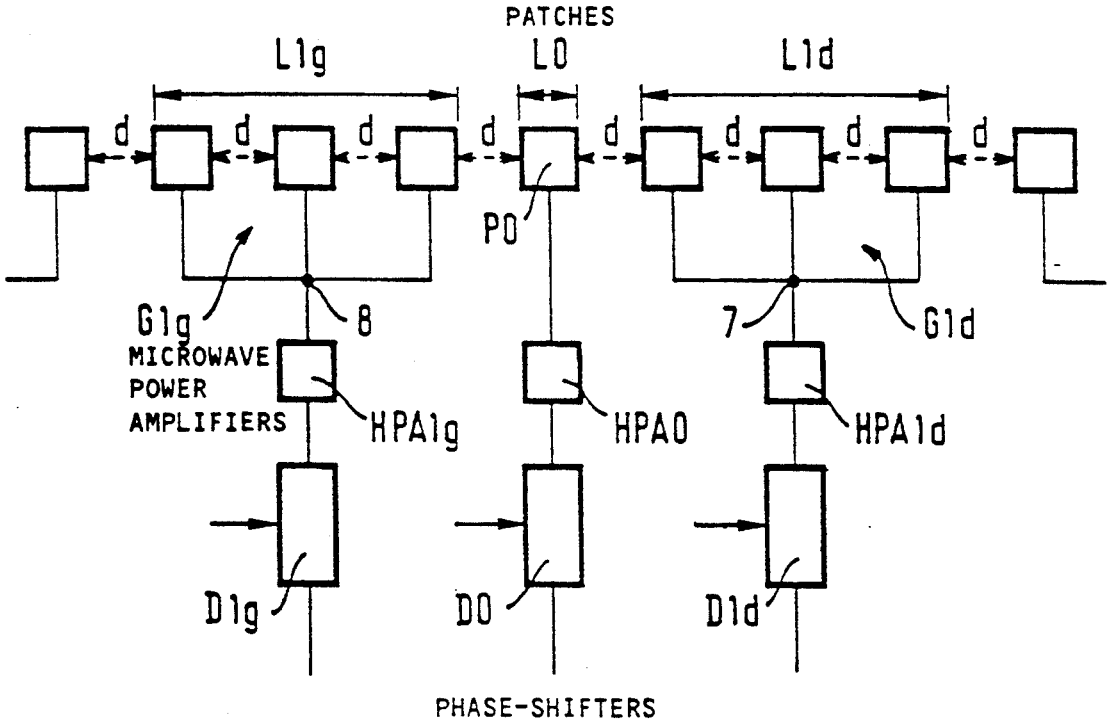
FIG. 4 shows a variant of the FIG. 3 implementation.

Finally, FIG. 4 shows a more economical variant of the FIG. 3 array in which the patches used are all identical to the central patch P0 but are grouped by electrical branch connections with several consecutive patches in each group, the number of patches per group G1d, G1g, etc. increasing progressively away from the central patch P0.

In this embodiment in which each patch is as previously separated from the adjoining patch by an edge-to-edge distance d equal to half the guided wavelength, the first two groups of patches G1d and G1g on each side of the single central patch P0 each comprise three patches whose feeds are joined at a respective common point 7 and 8, which define respective widths L1d and L1g. The next two groups G2d and G2g (not shown) each comprise five patches, the next two groups seven patches, and so on.

It goes without saying that the invention is not limited to the previous embodiments. It applies in just the same manner to implementing two-dimensional plane arrays: in this case the dimension of the sources increases from the center of the array towards the edges both along the abscissa axis and along the ordinate axis. In the case of an array which is in the shape of a plane body of revolution, the progressive increase of the source dimensions is effected in a similar way from the center towards the periphery of the structure.

In the case of an antenna comprising an array conformed to a surface which is the shape of a body of revolution with any profile (circular cylindrical, frustoconical, etc.), for example as in French patent application No 91 05510 filed May, 6, 1991, comprising a plurality of generatrices of radiating elements, each of these generatrices comprises a series of radiating elements comprising, as in FIGS. 3 and 4, for example, a central element between similar radiating elements on either side but of progressively increasing widths disposed so as not to create illumination gaps on the generatrix.

There is claimed:

1. A microwave array antenna comprising a plurality of radiating sources whose widths measured in a direction from a center of the array towards its ends increase progressively from the center of the array towards its ends while the heights of said sources in a direction perpendicular to said widths remain constant from the center of the array towards its ends, said radiating sources being disposed relative to each other in such a way that substantially no gaps are created in an illumination pattern of the array.

2. The array antenna according to claim 1 wherein said sources progressively widen in accordance with a geometrical progression.

3. The array antenna according to claim 2 wherein the width $L_n$ of the source of rank n is related to the width $L_{n-1}$ of the source of ran (n−1) by an equation in the form:

$$L_n/L_{n-1}=(130\ k)$$

where k is a constant increase factor.

4. The array antenna according to claim 1 wherein said radiating sources are arranged in groups with each source in a group being identical, and a progressive increase in width is applied to said groups of identical sources.

5. The array antenna according to claim 1, wherein each radiating source has an output side, said antenna further comprising: a variable phase-shifter for scanning the beam electronically, and a microwave power amplifier for each source, said phase shifter and amplifier being connected in series on the output side of each source, all said amplifiers being identical and having the same power rating equal to their common optimal power rating.

6. The array antenna according to claim 1 wherein said radiating sources are radiating horns each separated from the adjacent horn by a common wall.

7. The array antenna according to claim 1 wherein said radiating sources are radiating patches each separated from the adjacent patch by a distance substantially equal to half the guided wavelength.

8. The array antenna according to claim 7 wherein each path comprises a group of identical patches electrically interconnected and separated from each other by a distance substantially equal to half the guided wavelength.

9. The array antenna according to claim 1 wherein said antenna is a plane array antenna and the widths of said sources increase progressively from the center of said array towards the edges along two coordinate axes.

10. The array antenna according to claim 1, wherein said antenna is in the shape of a plane body of revolution and wherein the widths of said sources increase progressively from the center of said plane body of revolution toward its periphery.

11. The array antenna according to claim 1 conformed to a surface in the shape of a body of revolution of any profile and comprising a plurality of radiation element generatrices each comprising a series of radiating elements comprising a central element between similar radiating elements on either side whose width increases progressively and which are disposed in such a way as not to create any gaps in an illumination pattern of said generatrix.

12. The array antenna according to claim 1, wherein said antenna is an active receive array comprising a low-noise amplifier coupled to receive an output from each source and a variable phase-shifter coupled to an output of each low-noise amplifier.

13. The array antenna according to claim 1, wherein said antenna is an active transmit array comprising a series connection of a variable phase-shifter and a microwave power amplifier coupled to an output of each source.

14. The array antenna according to claim 1, wherein said antenna is an active radar array comprising a receive channel having a low-noise amplifier for each source and a first variable phase-shifter on the output side of each low-noise amplifier, a transmit channel having a second variable phase-shifter and a microwave power amplifier on the output side of each second variable phase shifter, said transmit channel and receive channel being switched alternately and each comprising a dedicated microwave amplifier.

15. The antenna according to claim 13 wherein said amplifiers have the same power rating.

16. The antenna according to claim 14 wherein said amplifiers have the same power rating.

17. The array antenna according to claim 1 disposed on the focal line of a cylindrical-parabolic reflector to constitute a high-gain antenna electronically scanned in the plane formed by the linear array and the line through the tips of the parabolic sections.

* * * * *